US010713884B2

(12) United States Patent
Moskowitz

(10) Patent No.: US 10,713,884 B2
(45) **Date of Patent: *Jul. 14, 2020**

(54) METHODS, SYSTEMS, AND APPARATUS FOR PLAYING POKER, BLACKJACK AND BACCARAT

(71) Applicant: Ahmnon D. Moskowitz, Rockville, MD (US)

(72) Inventor: Ahmnon D. Moskowitz, Rockville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/277,272

(22) Filed: Feb. 15, 2019

(65) Prior Publication Data

US 2019/0244474 A1 Aug. 8, 2019

Related U.S. Application Data

(63) Continuation of application No. 15/945,561, filed on Apr. 4, 2018, now Pat. No. 10,269,206, which is a continuation-in-part of application No. 15/657,811, filed on Jul. 24, 2017, now Pat. No. 10,186,108, which is a continuation-in-part of application No. 15/162,541, filed on May 23, 2016, now Pat. No. 9,965,924, which is a continuation-in-part of application No. 14/332,351, filed on Jul. 15, 2014, now Pat. No. 9,898,895, said application No. (Continued)

(51) Int. Cl.
*G07F 17/32* (2006.01)
*G07F 17/34* (2006.01)

(52) U.S. Cl.
CPC ..... *G07F 17/3213* (2013.01); *G07F 17/323* (2013.01); *G07F 17/3209* (2013.01); *G07F 17/3244* (2013.01); *G07F 17/3246* (2013.01); *G07F 17/3262* (2013.01); *G07F 17/3276* (2013.01); *G07F 17/3293* (2013.01); *G07F 17/34* (2013.01)

(58) Field of Classification Search
None
See application file for complete search history.

(56) References Cited

U.S. PATENT DOCUMENTS 3,796,433 A 3/1974 Fraley et al.
4,339,134 A 7/1982 Macheel
4,380,334 A 4/1983 Minkoff et al.
(Continued)

FOREIGN PATENT DOCUMENTS

WO 2004015529 A2 2/2004

OTHER PUBLICATIONS https://en.wikipedia.org/wiki/Catch_21. Accessed Jul. 16, 2018.
(Continued)

*Primary Examiner* — Ronald Laneau
(74) *Attorney, Agent, or Firm* — The Roy Gross Law Firm, LLC; Roy Gross

(57) ABSTRACT

Methods, systems and apparatuses of and for playing electronic or electro-mechanical wager gaming devices, including a player interface, of and for playing a poker and "video poker" type game based at least in part upon card-deck games such as but not limited to poker. The methods, systems and apparatuses include a plurality of configurations with multiple rule sets to facilitate the inducement and build game player excitement.

20 Claims, 13 Drawing Sheets

Related U.S. Application Data

15/657,811 is a continuation-in-part of application No. 14/332,351.

(60) Provisional application No. 62/165,870, filed on May 22, 2015, provisional application No. 61/846,608, filed on Jul. 15, 2013.

(56) References Cited

U.S. PATENT DOCUMENTS

| | | | | |
|---|---|---|---|---|
| 5,154,429 | A | 10/1992 | LeVasseur | |
| 5,257,789 | A | 11/1993 | Levasseur | |
| 5,395,119 | A | 3/1995 | Jacob et al. | |
| 5,605,334 | A | 2/1997 | Mccrea, Jr. | |
| 5,791,991 | A | 8/1998 | Small | |
| 5,823,873 | A | 10/1998 | Moody | |
| 6,345,823 | B1 | 2/2002 | Webb | |
| 6,581,937 | B1 | 6/2003 | Crisswell | |
| 6,588,747 | B1 | 7/2003 | Seelig | |
| 7,367,564 | B2 | 5/2008 | Latell | |
| 7,591,728 | B2 | 9/2009 | Gioia et al. | |
| 7,758,411 | B2 | 7/2010 | Crawford, III et al. | |
| 7,785,182 | B2 * | 8/2010 | Thomas | G07F 17/3293 273/292 |
| 7,785,184 | B2 | 8/2010 | Jubinville et al. | |
| 7,824,254 | B2 | 11/2010 | Dunaevsky et al. | |
| 8,926,421 | B2 | 1/2015 | Arezina et al. | |
| 9,257,006 | B2 | 2/2016 | Gagner et al. | |
| 9,286,747 | B2 | 3/2016 | Chang | |
| 9,552,701 | B2 | 1/2017 | Pececnik | |
| 9,679,303 | B1 | 6/2017 | Griffin | |
| 2002/0111205 | A1 | 8/2002 | Beavers | |
| 2002/0147042 | A1 | 10/2002 | Vuong et al. | |
| 2003/0027621 | A1 | 2/2003 | Libby | |
| 2004/0015529 | A1 | 6/2004 | Tanrikulu et al. | |
| 2004/0176155 | A1 | 9/2004 | Gold et al. | |
| 2007/0120320 | A1 | 5/2007 | Miltenberger et al. | |
| 2007/0135203 | A1 | 6/2007 | Nicely | |
| 2008/0073852 | A1 | 3/2008 | Cutchin | |
| 2008/0076572 | A1 | 3/2008 | Nguyen et al. | |
| 2008/0246219 | A1 | 10/2008 | Kyrychenko | |
| 2009/0121434 | A1 | 5/2009 | Baerlocher et al. | |
| 2009/0295087 | A1 | 12/2009 | Kling et al. | |
| 2010/0078892 | A1 | 4/2010 | Gore | |
| 2010/0130280 | A1 | 5/2010 | Arezina et al. | |
| 2010/0213671 | A1 * | 8/2010 | Ko | A63F 1/00 273/292 |
| 2010/0261515 | A1 | 10/2010 | Tobias et al. | |
| 2010/0298039 | A1 | 11/2010 | Dunaevsky et al. | |
| 2011/0057390 | A1 | 3/2011 | Scalisi | |
| 2011/0140359 | A1 | 6/2011 | Polynice | |
| 2013/0102381 | A1 | 4/2013 | Nelson et al. | |
| 2014/0038680 | A1 | 2/2014 | Pececnik et al. | |
| 2014/0094238 | A1 * | 4/2014 | Huxley | G07F 17/322 463/12 |
| 2015/0266662 | A1 | 9/2015 | Bajrami | |
| 2015/0325079 | A1 | 11/2015 | Alsip | |
| 2016/0379443 | A1 | 12/2016 | Abbott | |
| 2017/0046910 | A1 | 2/2017 | Sherrets et al. | |
| 2017/0053473 | A1 | 2/2017 | Colvin | |
| 2017/0345257 | A1 | 11/2017 | Gagner | |

OTHER PUBLICATIONS https://play.google.com/store/apps/details?id=air.com.differencegames.towerof21free, Accessed Jul. 16, 2018.

https://www.gsn.com/games/free/catch21, Accessed Jul. 16, 2018.

Notice of References Cited, U.S. Appl. No. 14/322,351, dated May 12, 2016.

"7 11 21 Lottery Scratch off tickets." Youtube.com. Online. May 28, 2012. Accessed via the Internet. Accessed Apr. 22, 2020. <URL: https ://www. you tube .com/watch?v=AF7bSarQkBQ> (Year: 2012).

Golden Bingo—GM #77. molottery.com. Online. Sep. 28, 2015. Accessed via the Internet. Accessed Apr. 22, 2020. <URL: http://www.molottery.com/scratchers .do?method=singlegame&game= 77> (Year: 2015).

Run the Table ctlottery.com. Online.Apr. 25, 2016. Accessed Apr. 22, 2020. <URL: https://www.ctlottery.org/ScratchGames/1337/> (Year: 2016).

* cited by examiner

| Select House Hand | 17 | 18 | 19 | 20 |
|---|---|---|---|---|

1. How many zones

| 1 | 2 | 3 | 4 |
|---|---|---|---|

2. 18-21 or bust ☐ 21 or bust ☐ Combination bets 18-21/ 21 or bust ☐

*Two games equal two bets*

3 .Play compound blackjack *select only If more than one zone is* selected yes ☐ no ☐

If 18-21, or 21 is selected it is one additional bet if the combination is selected it is two additional bets, If a player selects option 3 *Combination bets 18-21/ 21 or bust* the amount of bets would be doubled . For example if player selects 3 zones for option 1 and yes for number 5 options the amount of bets would double to eight.

| | | | | | | | | | | | |
|---|---|---|---|---|---|---|---|---|---|---|---|
| | 0 | 1 | 2 | 3 | 4 | 5 | 6 | 7 | 8 | 9 | 10/j/q/k |
| 1 | A | 11 | 12 | 13 | 14 | 15 | 16 | 17 | 18 | 19 | 20 |

| | | | | | | | | | | | |
|---|---|---|---|---|---|---|---|---|---|---|---|
| | 0 | 1 | 2 | 3 | 4 | 5 | 6 | 7 | 8 | 9 | 10/j/q/k |
| 2 | A | 11 | 12 | 13 | 14 | 15 | 16 | 17 | 18 | 19 | 20 |

| | | | | | | | | | | | |
|---|---|---|---|---|---|---|---|---|---|---|---|
| | 0 | 1 | 2 | 3 | 4 | 5 | 6 | 7 | 8 | 9 | 10/j/q/k |
| 3 | A | 11 | 12 | 13 | 14 | 15 | 16 | 17 | 18 | 19 | 20 |

| | | | | | | | | | | | |
|---|---|---|---|---|---|---|---|---|---|---|---|
| | 0 | 1 | 2 | 3 | 4 | 5 | 6 | 7 | 8 | 9 | 10/j/q/k |
| 4 | A | 11 | 12 | 13 | 14 | 15 | 16 | 17 | 18 | 19 | 20 |

| | | | | | | | | | |
|---|---|---|---|---|---|---|---|---|---|
| Bet Amount | 0.25 | 0.5 | 1 | 2 | 3 | 4 | 5 | 10 | 20 |

| | | | | | | | |
|---|---|---|---|---|---|---|---|
| Number of games : | 1 | 2 | 3 | 4 | 5 | 10 | 20 |

| | | |
|---|---|---|
| Bonus Multiplier | yes | no |

*Figure 3*

*Pokerpick*

*Step 1:*

*Option A Select your card(s)* ☐ *or Option B select zone to win* ☐

*Select Zone for option B* 1 2 3 4 5 6 7 8 9

*Step 2 if you selected card(s) to win select bet type*

Pick any card ☐

Pick Any 2 cards ☐

Card Box ☐ Games would be the total amount of bets *I.e. 3 cards would be 3 bets 4 cards would be 6 bets.*

Select your cards or QP ☐

| | | | | | | | | | | | | |
|---|---|---|---|---|---|---|---|---|---|---|---|---|
| Diamonds | 2 | 3 | 4 | 5 | 6 | 7 | 8 | 9 | 10 | J | Q | K | A |
| Clubs | 2 | 3 | 4 | 5 | 6 | 7 | 8 | 9 | 10 | J | Q | K | A |
| Hearts | 2 | 3 | 4 | 5 | 6 | 7 | 8 | 9 | 10 | J | Q | K | A |
| Spades | 2 | 3 | 4 | 5 | 6 | 7 | 8 | 9 | 10 | J | Q | K | A |

*Step 3*

Bet Amount 0.25 0.5 1 2 3 4 5 10 20

Number of games: 1 2 3 4 5 10 20

Bonus Multiplier yes no

Rules: *Each zone will be dealt two randomly selected cards and there will be 5 random community cards* zone 1
zone 2
zone 3
zone 4
zone 5
zone 6
zone 7
zone 8
zone 9

C1 C2 C3 C4 c5

If your selected hand beats all the hands in the zone you win the corresponding payout. If there is a tie there is a subordinate payout. Payouts for the card vary according to the chances of winning.

Figure 4C

*HV (horizontal vertical) POKER*

*Step 1:*

*Select bet type*

*A.* ☐ *Pick a line to win*

*B.* ☐ *Pick the poker hand that will win*

*C.* ☐ *Select the line and the hand that will win*

*Step 2: If you selected A use box 1. If you selected B use Box 2. If you selected C use both 1 and 2 or QP*

☐

1 *Select a vertical or horizontal*

| |
|---|
| Horizontal 1 |
| Horizontal 2 |
| Horizontal 3 |
| Horizontal 4 |
| Horizontal 5 |

| | | | | |
|---|---|---|---|---|
| Vertical 1 | Vertical 2 | Vertical 3 | Vertical 4 | Vertical 5 |

2 Select which hand will be the highest: If you selected a line to win only select valid selections for the lines i.e. a straight cannot be in a line with four cards or less.

*High hand* ☐ *Pair 2-10* ☐ *pair J-A* *two pair* ☐ *straight* ☐ *flush* ☐ *Full house* ☐ *four of a kind* ☐ *four aces* ☐ *straight flush* ☐ *royal flush* ☐ *Five of a kind* ☐

*Step 3*

| | | | | | | | | | |
|---|---|---|---|---|---|---|---|---|---|
| Bet Amount | 0.25 | 0.5 | 1 | 2 | 3 | 4 | 5 | 10 | 20 |

| | | | | | | | |
|---|---|---|---|---|---|---|---|
| Number of games: | 1 | 2 | 3 | 4 | 5 | 10 | 20 |

| | | |
|---|---|---|
| Bonus Multiplier | yes | no |

*Payouts vary depending on the selection. Subordinate payout for a tie.*

Figure 5D

METHODS, SYSTEMS, AND APPARATUS FOR PLAYING POKER, BLACKJACK AND BACCARAT

CROSS-REFERENCE TO RELATED APPLICATIONS

The application is a continuation of U.S. Ser. No. 15/945,561 filed Apr. 4, 2018, which is a continuation of U.S. application Ser. No. 15/657,811 filed Jul. 24, 2017, which is a continuation-in-part of U.S. application Ser. No. 15/162,541 filed on May 23, 2016, which claims priority to U.S. Provisional Patent Application No. 62/165,870 filed May 22, 2015.

U.S. application Ser. No. 15/657,811 is a continuation-in-part of U.S. patent application Ser. No. 14/332,351 filed Jul. 15, 2014 which claims priority to U.S. Provisional Patent Application No. 61/846,608, filed Jul. 15, 2013.

The entire contents of the above identified patent applications are hereby incorporated by reference in their entirety.

FIELD OF THE INVENTION

The present invention relates generally to a numbers game, more specifically; blackjack, poker or baccarat card games.

BACKGROUND OF THE INVENTION

Card games are a staple of most casinos and played electronically on gaming devices or on client devices, which communicate with servers over a network.

U.S. Pat. Nos. 3,796,433 and 5,257,789 and International Publication No. WO/2004015529 are examples of means of electronic blackjack. U.S. Pat. No. 5,605,334 is an example of an electronic smart system used for keeping track of wagers. U.S. Pat. Nos. 6,581,937 and 7,367,564 are examples of math games where players have no control of the starting variables. U.S. Pat. Nos. 5,823,873, 7,758,411, 4,339,134, 4,380,334 are examples of electronic poker and the methods played therein.

In blackjack, generally the object is to get 21 or have a value that is of greater value than the dealer. Generally the object of poker is to get the highest poker hand possible with some variations like Omaha-high low or Razz the objective is to get the lowest value.

SUMMARY OF INVENTION

The present invention recognizes that, in the current variations of the aforementioned games, a player has no control of the starting hand. Many players fold and surrender all or a portion of their initial wager if they do not like their starting hand.

The present invention solves these and other problems by giving a player more excitement and options by allowing players the option of pre-determining the starting variables with payouts that are in general correspondence with their selection(s).

In an exemplary embodiment, a player selects a starting value(s) S. In the black jack embodiment 5 can be any value {0-20} and an ace variable is counted as a one or eleven. In baccarat the starting value S is {0-9}. In poker S could be one or a combination of values {A,2,3,4,5,6,7,8,9,10,J,Q,K} with starting suits {hearts, spades, diamond, clubs}.

In these games, a player can 1) play against another player (s) 2) play against gaming operators draw. 3) Play to achieve a predetermined objective. The objective can either be a single variable denoted as X or a parameter objective P that contains plurality of variables.

In an exemplary embodiment, which for purposes of the present invention is identified as "Eighteen Twenty-one or Bust", the objective denoted as P is 18-21 and a single variable objective X is 21. A player can split the bet or place or wager on both the aforementioned options. A gaming operator can choose to offer a plurality parameters not in the preferred embodiment for example: {16-21}, {17-21}, {20-22} {23-25} {16,18,21,25} etc. In this embodiment the preferred variable X is 21 however a gaming operator can make it higher or lower and can choose to allow a player to select a plurality of x objectives: i.e., (21), (22), (29).

If a player achieves the objective(s) X and or P they will be entitled to a payout that is in general correspondence with the possibility of achieving the said objective.

In another exemplary embodiment, which for purposes of the present invention is identified as "compound blackjack" or "grand slam blackjack" and "compound baccarat" or "grand slam baccarat" a player can play multiple hands n with the objective of winning all of the hands. If a player would achieve the objective they will be entitled to a payout that would correspond to the frequency of winning. For example, a player would select a starting variable S for four games and if the player reaches the objective for all their hands they would be entitled to a payout that corresponds with the possibility of winning that hand.

In grand slam blackjack and baccarat a dealer deals card(s) C. In order to select C a gaming operator can use a single deck, multiple decks, or alter the variables within to and change the chances of achieving the objective. This embodiment can be done concurrently in a single deal or subsequently throughout many games. A gaming operator can also elect to have an objective of winning only a portion of the n games i.e 3 out 4 hands with corresponding payouts if a player reaches their objective.

A gaming operator has the option of selecting a single assembly of cards against multiple player zones. For example, initial bets are placed on S12 and S18 by a player. The first card C is a 4 so the zone with the 18 loses because it was a bust (22), the second card C2 is a 5 so the S12 would win (21). In another exemplary embodiment, a gaming operator deals a separate assembly of cards to each of the player's zones.

In a further exemplary embodiment, this system can be applied to baccarat where the primary objective x is 9 and the parameter objective is close to 9, i.e. 7-9.

In another exemplary embodiment, which for purposes of the present invention is identified as conversion: a player starts playing regular cards with traditional rules, a player is dealt an initial hand. After viewing the initial hand and/or viewing the hand of the gaming operator, community cards, other players hands, a player has the option of converting the game into one of the embodiments herein. A gaming operator can elect there to be no extra cost to the player or they can charge a fee for the conversion. For example 50% of the wager can be charged for a conversion in blackjack if the dealer is showing an ace.

In another exemplary embodiment, this can be played generally with numbers or symbols that represent numbers. For example, a player selects the numerical objective X {777} and or P {677-777} a player selects from a plurality of possible starting values each value has a generally different possibility of achieving the objective. The gaming operator deals variables to the player that adds, subtracts, multiplies, or divides the players hand value if they achieve the objective(s) the player would be entitled to a payout that is in general correlation with the chances of winning. As a side bet in the exemplary embodiments of the games described herein, the gaming operator has the option of allowing a player to select the numerical value of the cards with a payout that would correspond to the general chances of winning.

In an exemplary poker embodiment, a player selects a single S or a plurality of S's. The objective of the game generally is to obtain a high value poker hand and in some games like "Omaha high low" and "Razz," the objective of the game is to get the lowest value hand.

In another exemplary embodiment, there are community cards that will be randomly selected. There can be zone(s) that will be dealt randomly selected cards. A player can select their own initial cards, e.g., {A,A} {K,K} {A,K,Q,} {2,7} {2,8}, or wager that one of the zones with randomly selected variables will win. A player whose hand together with the community cards makes up the highest hand would be entitled to a payout that is in general correspondence with the starting hands probability of winning. If there is a tie, a gaming operator has the option of awarding a subordinate payout.

In another exemplary embodiment, a player can play against other players. For example, one player can choose {A, A} and another {10, 10} and another player a {2, 7}. The player with {A, A} would have to anti the most since that hand combination has the highest chances of winning. The player with {2, 7} would have to anti the least since the chances of that player winning are substantially lower.

In a further exemplary poker embodiment, a player selects from a plurality of P parameters and each parameter contains different quantities of variables. For example, a player can select a zone in which each zone contains a different quantity of cards {1, 2, 3, 4, 5, 6, 7}. This can be a standalone game or played in combination with community cards. The hand with 7 cards would generally be entitled to the lowest payout since it has the highest chances of winning. The parameter with one card would generally be entitled to the highest payout since the chances of winning are substantially lower. The card(s) within the parameters can either be random or predetermined before the gameplay.

Another feature that can be used in the exemplary embodiments described herein is a player can select the gaming operators hand and be entitled to a payout that is in general correspondence to the frequency of winning that hand.

The payouts generally would be in correlation with the frequency or probability of winning. For example, in Blackjack, the odds of getting 21 from an initial starting value A is approximately 1:1.78; so a payout could be up to 1.7. For getting 18-21, the odds are approximately 1:1.2; so a payout could be 1.11. If a player selected the option to win a plurality of games, then the odds of winning, and hence payout, would be based on the probability of winning the plurality of games. For example, if a player selected the objective X as 21 and chose 20 as the initial starting value and the amount of hands n as 4, then the gaming operator uses a separate deck for each subset and the chances would be 1 \13*13*13*13 or 1:28,000; so a payout could be 25,000 times the wager amount.

The exemplary embodiments described herein can be played on a table apparatus or be played through an electronic server that uses a central processing unit. With the table game variations, these games can be used in conjunction with an electronic betting interface that is connected to an apparatus that utilizes smart recognition technology so it would be easier for the gaming operator pay the winners.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein:

FIG. 3 illustrates a bet sheet, according to an exemplary embodiment of the invention;

FIG. 4C illustrates a bet sheet for a game according to an exemplary embodiment of the invention;

FIG. 5D illustrates a game in which a player wagers that one of the horizontal or vertical rows will have the highest poker hand, according to an exemplary embodiment of the invention.

DETAILED DESCRIPTION OF THE EXEMPLARY EMBODIMENTS OF THE INVENTION

Figure 1A:
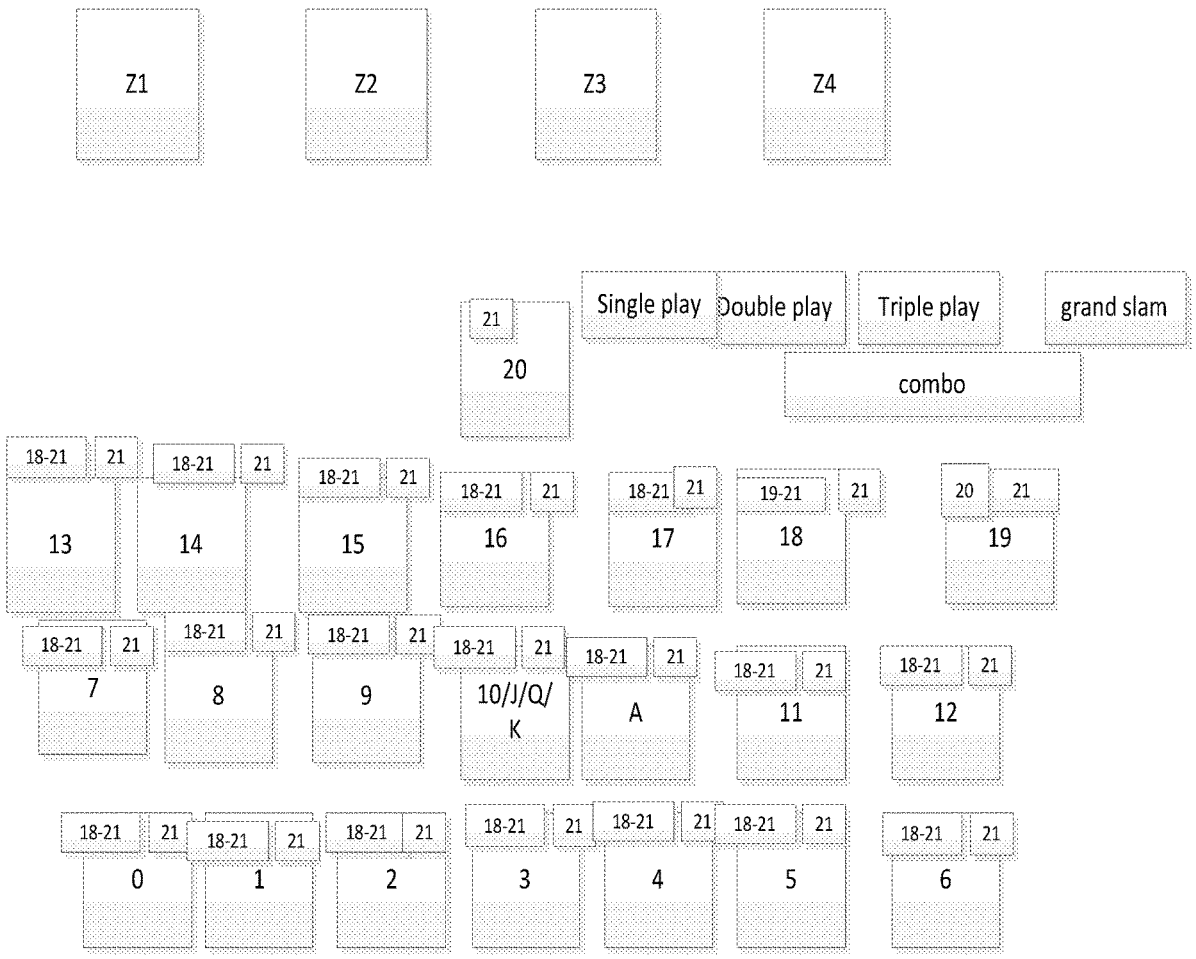
FIG. 1A illustrates a table or digital game board, according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1A-5D illustrate exemplary embodiments of a numbers game, more specifically, blackjack, poker or baccarat card games.

With reference to FIG. 1A, an example of a table or digital game board will now be described.

1) A player selects (a) starting position(s) S {0-20, A) and selects the objective a) 18-21, b) 21, c) both. Z1, Z2, Z3, Z4 represent gaming zones. A player can choose to play a single game Z or multiple zones. For a single game, the object of the game is to win one game. In Compound/Grand slam Blackjack and baccarat games, a player will wager that they will a plurality of games.

If a player selects the indicia double, then the Objective of the game is to win two games. If the player selects the triple indicia, then the objective of the game is to win three games. If the player selects the grand slam indicia, then the objective of the game is to win four games. By selecting "combination," a player would combine the Compound Black jack game with a single game option. If a player plays a "double play" with a combination, then that would be three games. If a player plays a "triple play" with combination, then that would be four games. If a player plays a "grand slam" with combination, then that would be five games.

Alternatively, a player can play standard blackjack and has the option of converting to one of the aforementioned options once the card(s) are dealt. The payouts to the player will be in general correspondence to the possibility of winning based on the starting position and/or the number of games selected.

Figure 1B:
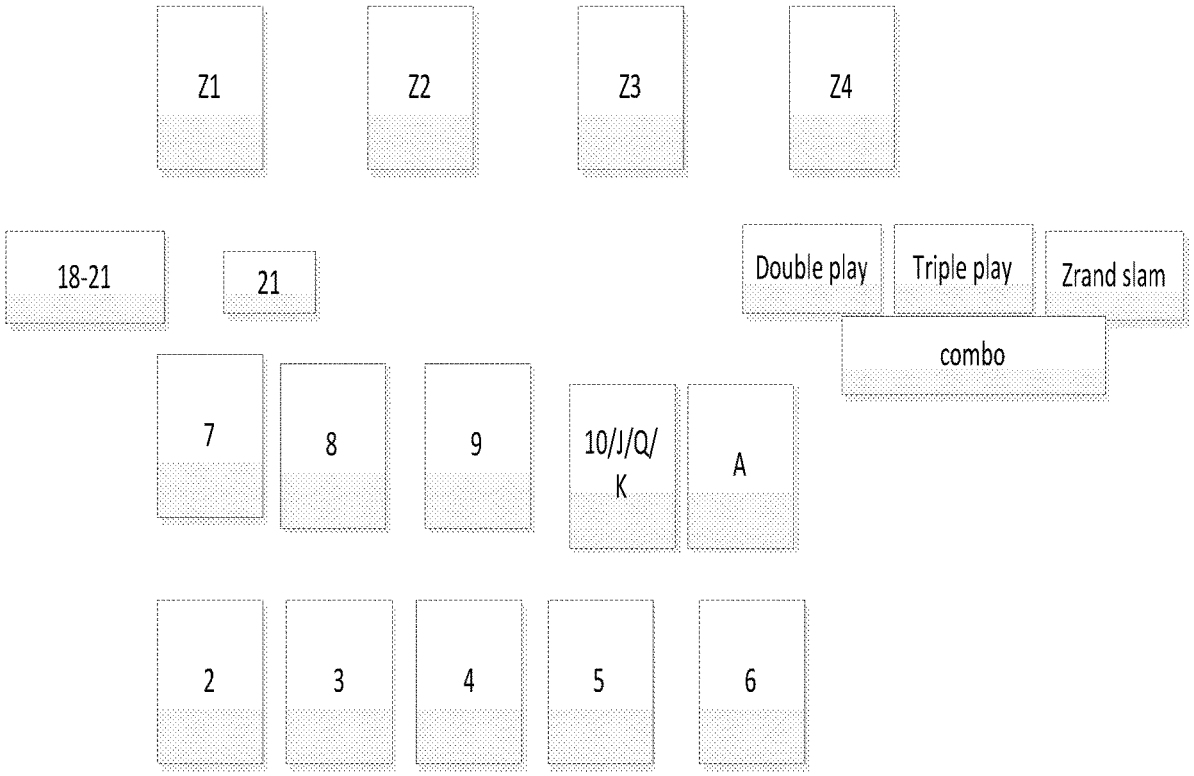
FIG. 1B illustrates a table or digital game board showing how the dealer separates cards into separate zones, according to an exemplary embodiment of the invention.

FIG. 1B illustrates an example alternative to the embodiment of FIG. 1, in which a player has fewer options. These options also can be used for baccarat and poker.

Figure 2A:
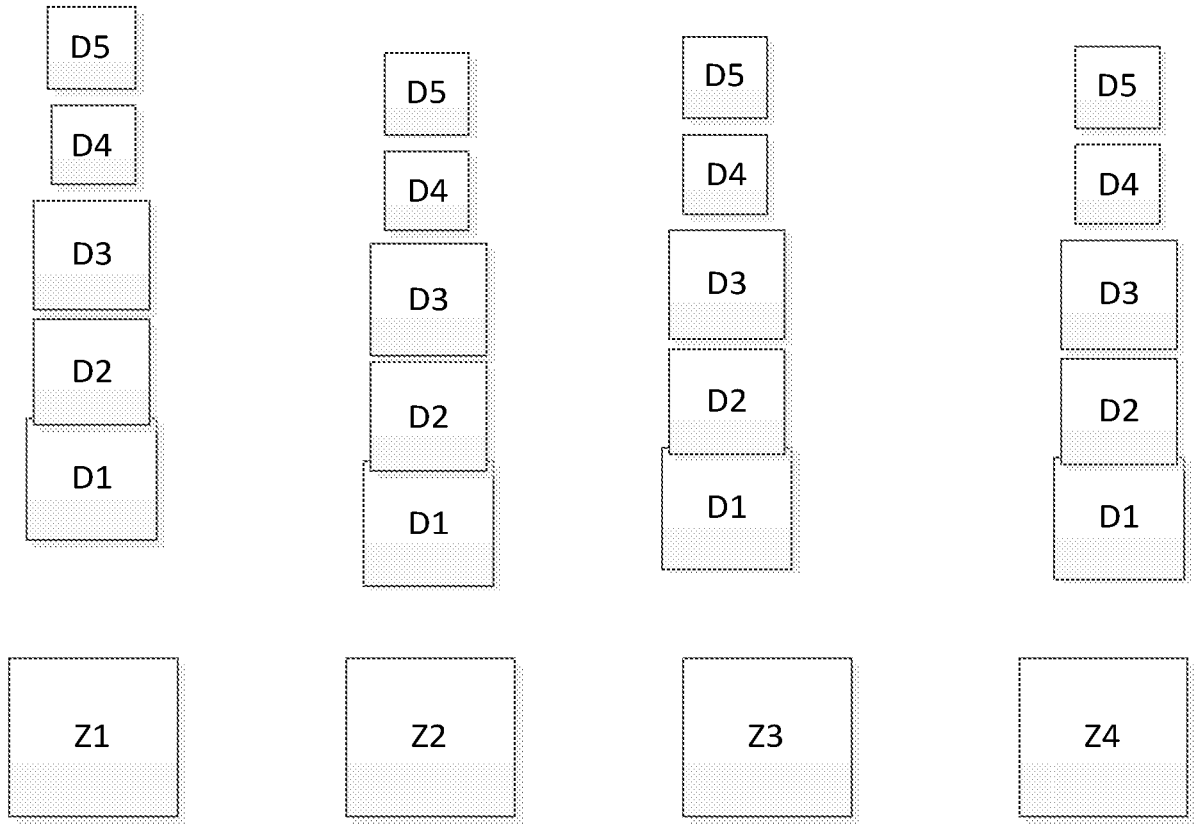
FIG. 2A illustrates cards dealt by a dealer to separate zones, according to an exemplary embodiment of the invention.

FIG. 2A illustrates an exemplary embodiment showing how the dealer deals separate cards to separate zones. In this example, Z represents the player's cards and D represents the cards that are dealt to those zones.

Figure 2B:
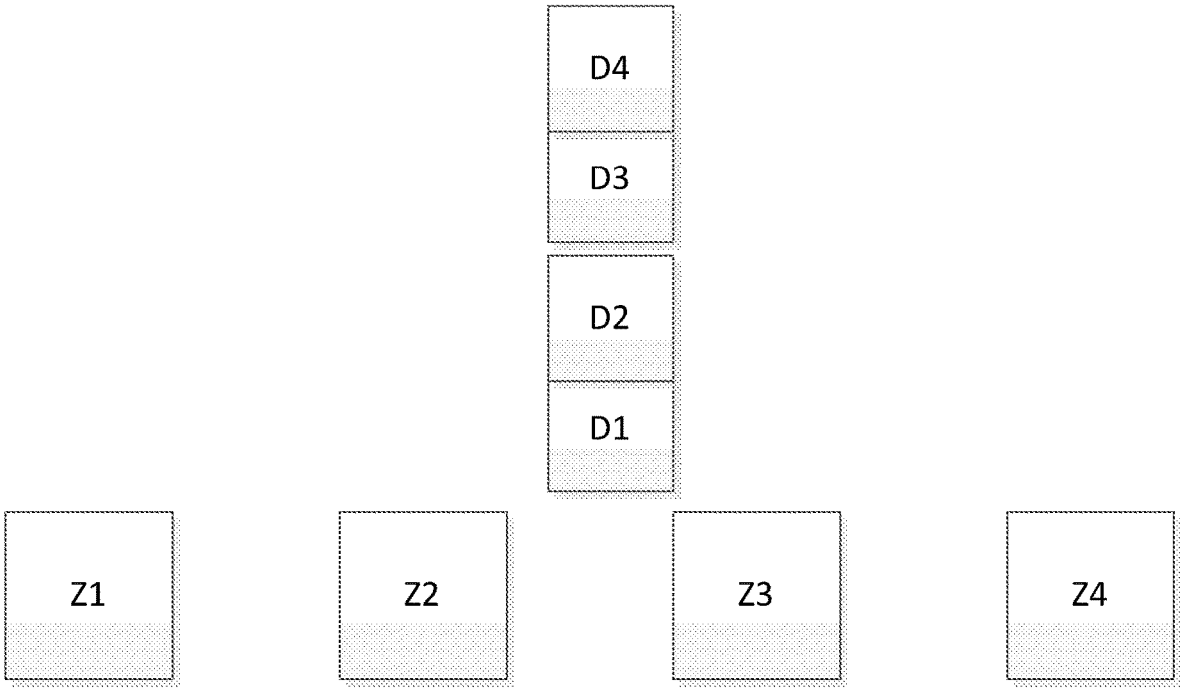
FIG. 2B illustrates an example of an instance in which a single draw assembly is applicable to a plurality of the players zones, according to an exemplary embodiment of the invention.

FIG. 2B illustrates an exemplary embodiment in which a single draw assembly D is applicable to a plurality of the player's zones.

Figure 2C:
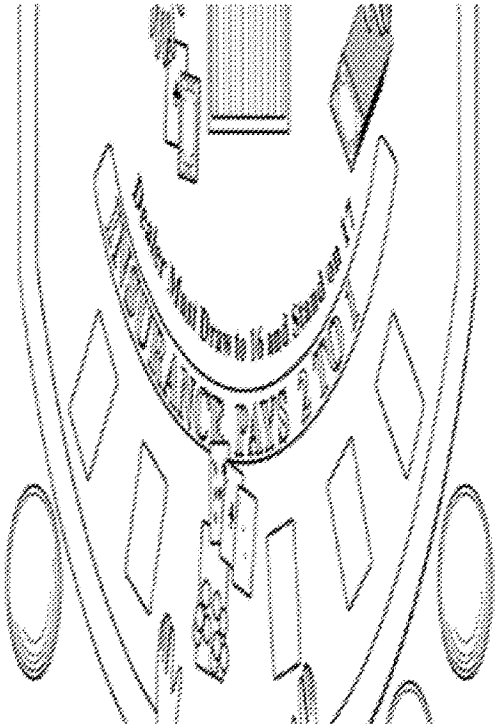
FIG. 2C illustrates a game having house rules in which a player has an option of selecting the starting hand of the dealer, according to an exemplary embodiment of the invention.

FIG. 2C illustrates an exemplary embodiment with house rules, with the exception that a player has the option of selecting the starting hand of the dealer, and if the player wins, the player will be awarded to a payout that corresponds to the odds of winning. In this example embodiment, the options are 17 through 20 for a dealer starting hand, with the 20 starting hand having the highest payout to a player and the 17 the lowest. However, a gaming operator can expand the options to include dealer starting hands of less than 17 where the dealer could be required to play with house rules.

FIG. 3 illustrates an exemplary embodiment of a bet sheet for compound blackjack. In this example, a player selects the objective: 18-21, 21, or a split bet. The player selects how many zones they want to play: e.g., 1, 2, 3, or 4. The player selects if they want to play regular blackjack or compound blackjack. In this example embodiment, both the 21 objective option and the 18-21 objective option are combined in a single sheet. To simplify the options for players, a gaming operator can create two separate bet sheets for the separate objectives. A gaming operator also can reduce the variables or the zone options such that there are fewer permutations, hence making it more economical for a gaming operator to develop.

Figure 4A:
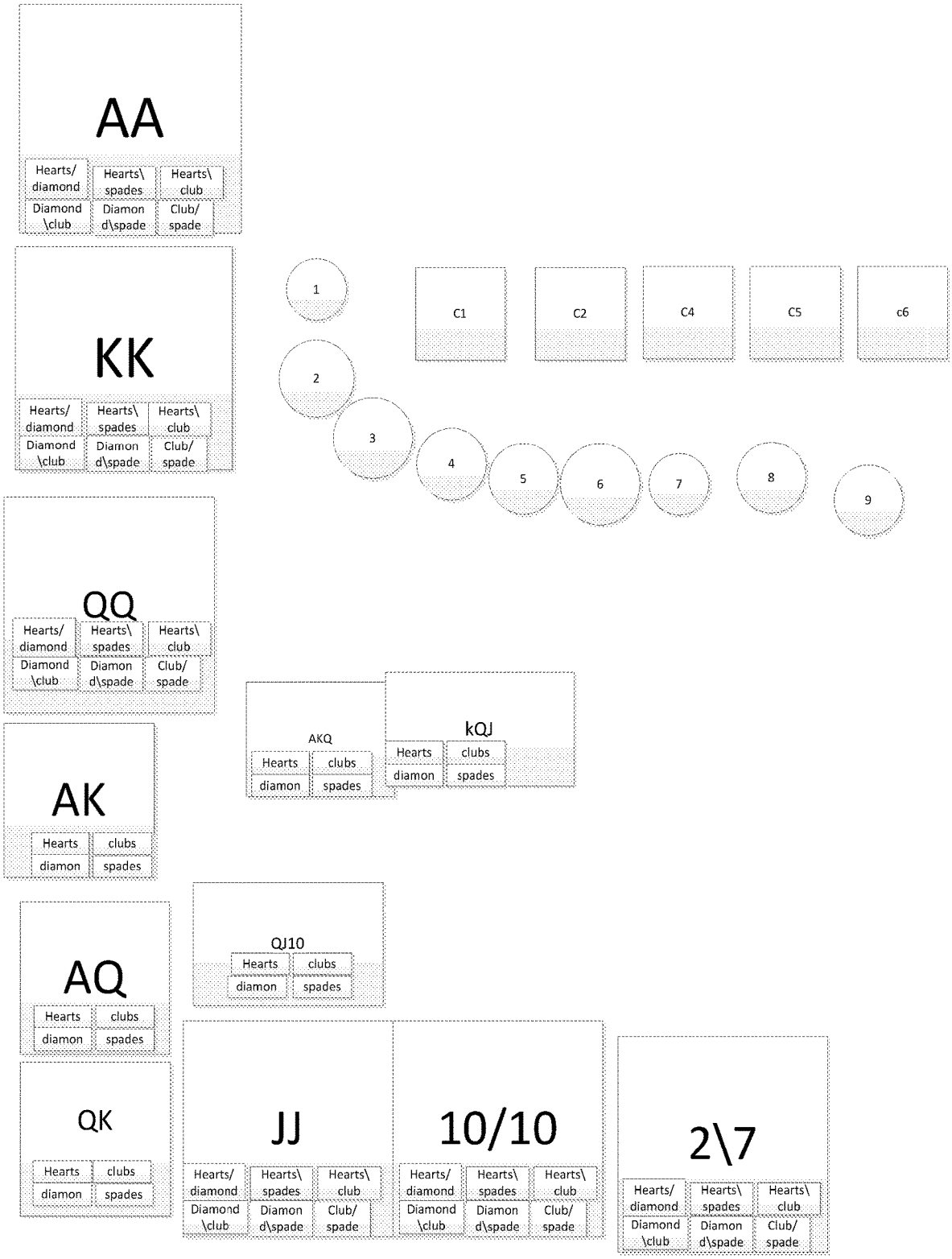
FIG. 4A illustrates a Poker game having community cards, according to an exemplary embodiment of the invention.

FIG. 4A illustrates an example of a Poker embodiment in which the game includes community cards C. The objective of this game is to form the optimal poker hand. The zones marked {1-9} will be dealt random cards to be combined with the community cards dealt. A player can either bet on the zones {1-9} or wager on a predetermined card indicia that will also be combined with the community cards. The payouts will be in general correspondence with the probability of winning based on the starting wager, i.e. the {2, 7} will have the highest payout for a two card selection.

Figure 4B:
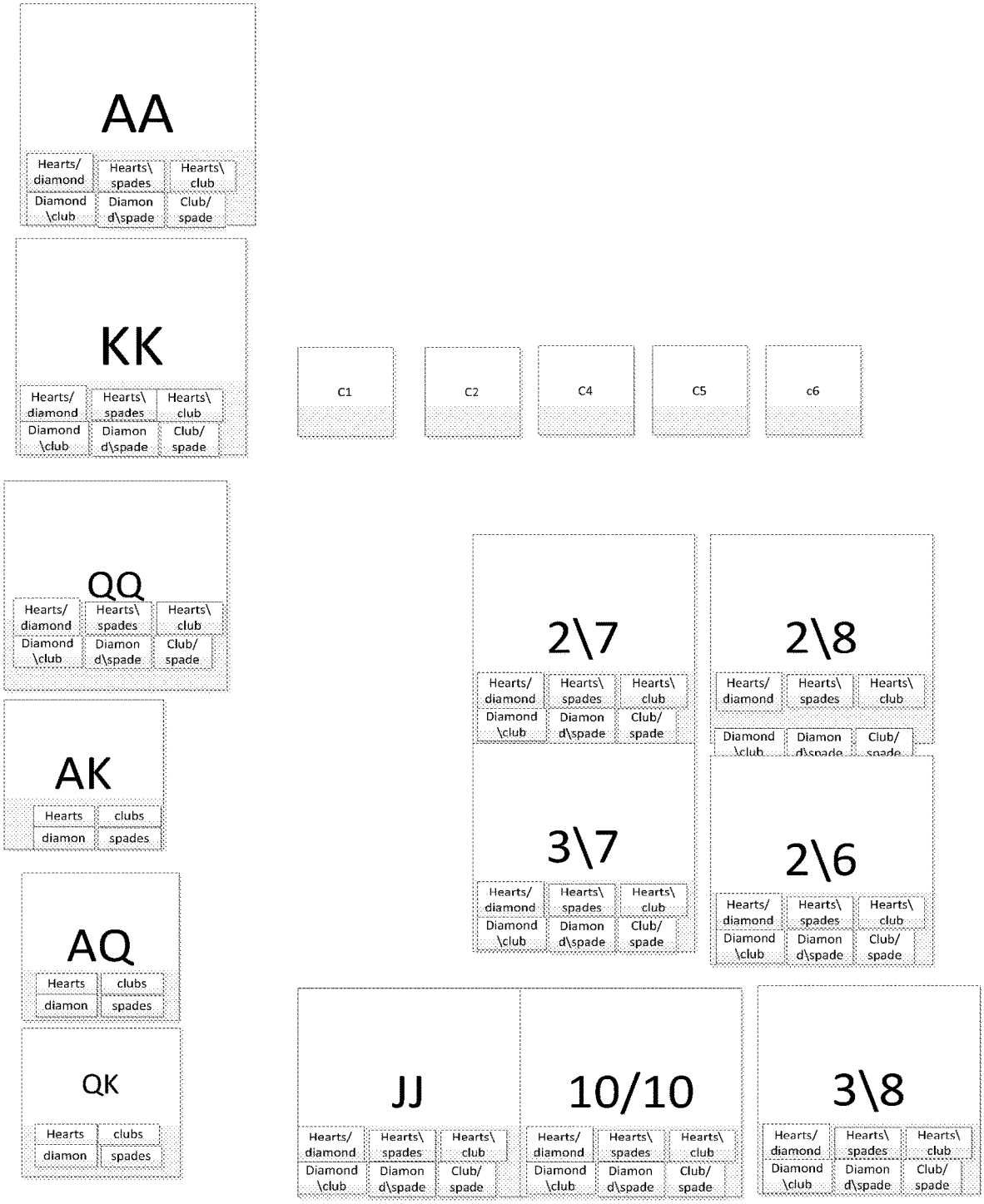
FIG. 4B illustrates a game having predetermined options for the starting hand, according to an exemplary embodiment of the invention.

FIG. 4B illustrates an exemplary embodiment of a game with predetermined options for the starting hand. A player can select their own starting hand or select the hand of the gaming operator. A player can play amongst other players or against the gaming operator. The payouts can be in general correspondence with the odds of winning. When players play amongst themselves, the players with the higher value initial hand would ante more and the players with the lesser value initial hand would ante less.

FIG. 4C illustrates a bet sheet for the poker variation with three steps. In Step one, a player selects A) (a) card(s) to beat the gaming operator's hand, or B) a specific zone that will have the optimal poker hand in combination with the community cards against the other zones. In step two, if a player selected option A from step 1, then the player will select from three options: A) a single card to beat all the gaming operator's hands; B) two cards to beat all the gaming operator's hands; and C) a Card box, which is a combination of hands to beat the gaming operator's hands. The player selects the cards or selects QP for a random selection. In step three, a player selects the amount of money to wager, the amount of games, and if the player wants a bonus multiplier.

Figure 5A:
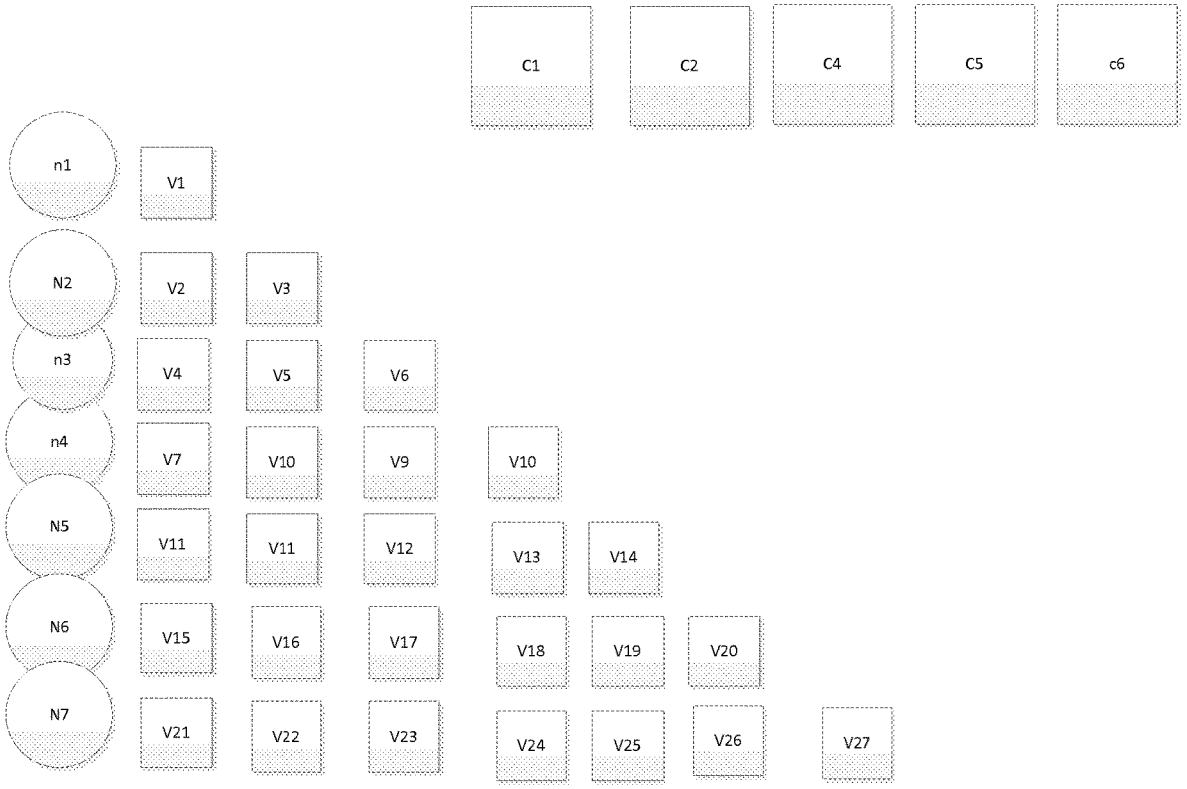
FIG. 5A illustrates a game in which the starting hand variable is the amount of cards, according to an exemplary embodiment of the invention.

FIG. 5A illustrates an exemplary embodiment in which the starting hand variable is the amount of cards, such as {N1, N2, N3, N4, N5, N6, N7}. The player can play to achieve the highest poker hand against the other cards or the highest hand in conjunction with the community cards. N1 generally offers the highest payout and N7 generally offering the lowest payout.

Figure 5B:
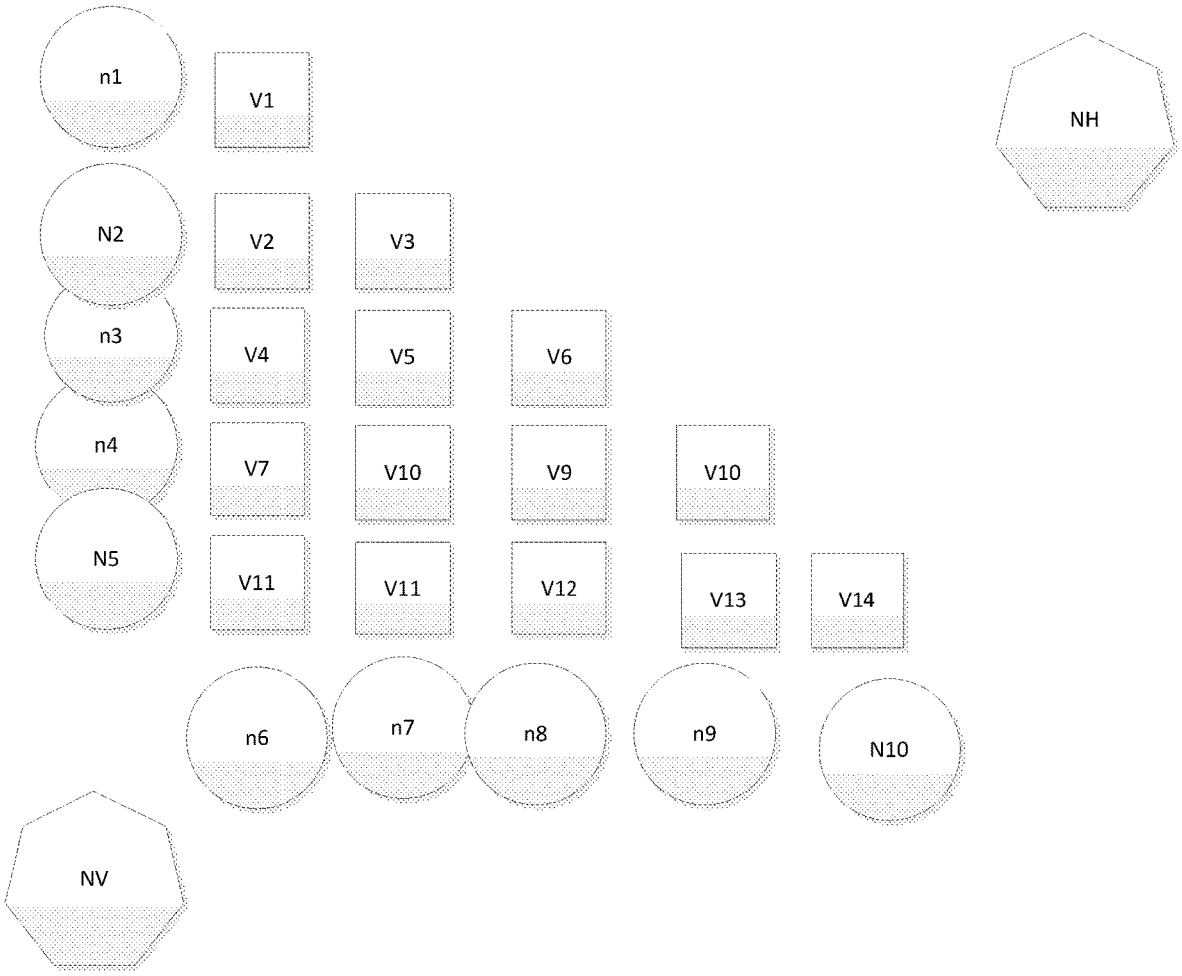
FIG. 5B illustrates a game in which a player bets on N1, N2, N3, N4, N5 in the horizontal or N6, N7, N8, N9, N10 in the vertical, according to an exemplary embodiment of the invention.

FIG. 5B illustrates an alternative exemplary embodiment in which a player bets on N1, N2, N3, N4, N5 in the horizontal or N6, N7, N8, N9, N10 in the vertical. A player also can select to wager if one of the horizontal parameters NH will win or if one of the vertical parameters NV will win.

Figure 5C:
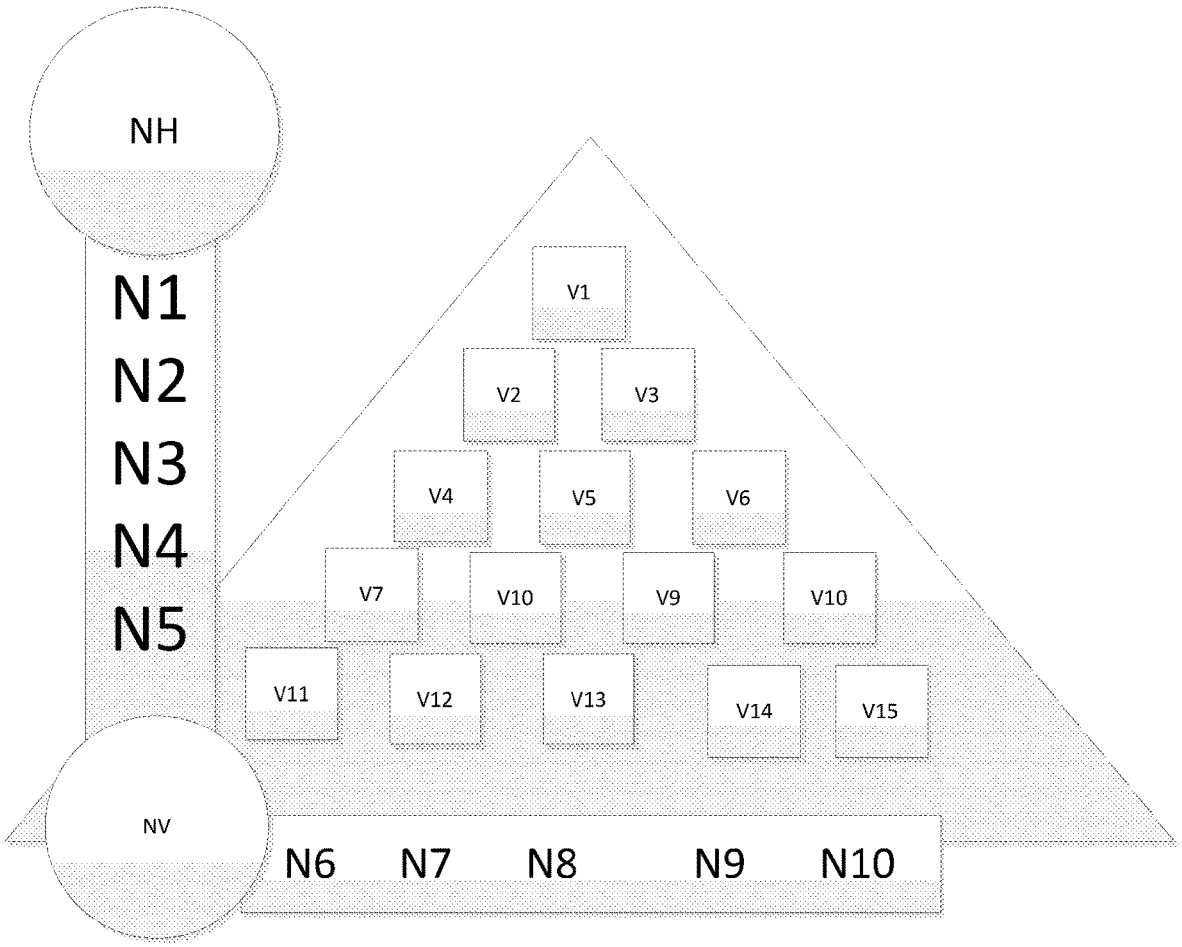
FIG. 5C illustrates a game in which a player wagers that one of the horizontal or vertical rows will have the highest poker hand, according to an exemplary embodiment of the invention.

FIG. 5C illustrates another exemplary embodiment in which a player can wager that one of the horizontal rows, e.g., {N1, N2, N3, N4, N4} will have the highest poker hand, or one of the vertical options will have the highest poker hand {N6, N7, N8, N9, N10}. In the bottom selection, the variables included are all the rows above so:

N6=v11+(v1, v2, v3, v4, v5, v6, v7, v8, v9, v10}
N7=v12+(v1, v2, v3, v4, v5, v6, v7, v8, v9, v10}
N8=v13+(v1, v2, v3, v4, v5, v6, v7, v8, v9, v10}
N9=v14+(v1, v2, v3, v4, v5, v6, v7, v8, v9, v10}
N10=v11+(v1, v2, v3, v4, v5, v6, v7, v8, v9, v10}.

For N1, if there is a tie a gaming operator has the option of making it the sole winner or there can be a plurality of winners or a subordinate payout. This variation can also be used with letters, symbols, and numbers for word and matching objectives.

FIG. 5D illustrates an exemplary embodiment of a poker bet sheet and can be used for any iteration of poker disclosed herein. The example bet sheet also can be used as a side bet or as an independent game with the blackjack layout for four or five zones. A player selects one of three bets: A) which line will contain the optimal poker hand; B) what the winning hand will be; or C) what the winning hand will be and which line will contain the winning hand.

An exemplary embodiment of the present invention is directed to a method for playing blackjack and baccarat including providing a player the opportunity to select a plurality of "S" starting position variables. There is a primary objective P that represents (a) numerical value(s). The payout to the player will be in general correspondence with the probability of the starting value S achieving the objective P.

In an example, S is 0-20. In another example, S can have a plurality of values.

In another example, the game can include an additional objective of winning a plurality of games with a payout that is in general correspondence with the probability of winning the plurality of games.

In yet another example, a player starts off playing blackjack selecting no initial starting position and has the option of converting the deal hand into a starting position S with a payout that is in general correspondence with the chances of achieving the objective P.

In an example, an initial staring position can be the number of cards. In another example, S is the gaming operator's hand. In another exemplary embodiment, the game is executed through an electronic server.

An exemplary embodiment of the present invention is directed to a gaming apparatus for playing blackjack and baccarat that provides a player the opportunity of selecting a plurality of "S" starting position variables. In this game, there is a primary objective P that represents (a) numerical value(s). The payout to the player is in general correspondence with (i.e., substantially corresponds to) the probability of the starting value S achieving the objective P.

Yet another exemplary embodiment of the present invention is directed to a method of playing poker in which a player selects the initial starting variable(s) S with the primary objective of achieving the optimal poker hand against an opponent's hand. The payout to the player is in general correspondence with the chances of the starting value S achieving the optimal poker hand.

In an example, S can be the amount of cards. In another example, S can be the gaming operator's initial hand. In yet another example, S can be the player's initial hand. In another example, the game is played against other players with initial antes that are in general correspondence with the chances of winning.

An exemplary embodiment of the present invention is directed to a method of playing poker above that is executed through an electronic server.

Yet another exemplary embodiment of the present invention is directed to a gaming apparatus for playing poker in which a player selects the initial starting variable(s) S with the primary objective of achieving the optimal poker hand against an opponent's hand. The payout to the player will be in general correspondence with the probability of the starting value S achieving the optimal hand.

Another exemplary embodiment of a gaming apparatus for playing blackjack and baccarat, includes a controller programmed to provide a player an opportunity to select a plurality of starting position variables "S", with an objective P that represents one or more numerical values, wherein the payout to the player substantially corresponds to a probability of the starting value S achieving the objective P.

Another exemplary embodiment of a gaming apparatus for playing poker, includes a controller programmed to control a game in which a player selects one or more initial starting position variables S with an objective of achieving an optimal poker hand against an opponent's hand, wherein the payout to the player substantially corresponds to a probability of the initial starting position variable S achieving the optimal poker hand.

One of ordinary skill in the art will recognize that other exemplary embodiments of a gaming apparatus can be provided with a controller programmed to control one or more of the embodiments of the games described herein. The gaming apparatus is not limited to any particular apparatus and can include, for example, a personal or public apparatus, computer, notebook, or tablet, an apparatus accessible by another apparatus over a local network connection or global network connection, such as the Internet, an apparatus in a casino or the like, an apparatus requiring payment from a player, etc.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. An electronic wagering gaming system for executing instructions over a network, the system comprising:

a processor;

a memory device storing instructions that when executed, cause the processor to control an electronic game of blackjack; and an interface for displaying the electronic game of blackjack, wherein the electronic game of blackjack includes at least one randomly selected communal card, a plurality of zones, and a dealer zone, wherein the plurality of player zones are capable of receiving cards, wherein the processor initiates the electronic game of blackjack by:

a) displaying on the interface an initial set of identical card values to at least a majority of the plurality of player zones, wherein each of the identical card values in the set of identical card values is greater than zero;

b) making a determination based on a player input whether to receive an additional communal card for the plurality of player zones;

c) applying the additional communal card to one of the plurality of player zones, wherein the application of the additional communal card is evaluated on a zone-by-zone basis;

wherein an evaluation by the processor is made to apply the communal card or the additional communal card to each of the plurality of player zones;

wherein individual player zone values are defined by a value of the applied communal card in addition to values of the initial identical card values, wherein when a determination is made that there should be no more cards dealt to one of the plurality of player zones, an evaluation is made of the dealer zone of whether to add a card value to the dealer zone, the card value being a next sequential communal card, the value of next sequential community card determined on a zone-by-zone basis;

wherein a determination is made by the processor of the player zone wins and loses the game by comparing the value of said one of the plurality of player zones against the dealer zone.

2. The electronic gaming system of claim 1, wherein an account balance of the player is adjusted based on a win or loss outcome of the plurality of player zones.

3. The electronic gaming system of claim 1, wherein physical cards are transmitted and received by the system via a smart recognition sensor communicating with the processor, the physical cards being applicable to the game of blackjack.

4. The electronic gaming system of claim 1, wherein the system further includes a separate game of baccarat and the game of baccarat is executed by the processor over the network.

5. The electronic gaming system of claim 1, wherein each of the plurality of player zones has an identical starting value.

6. The electronic gaming system of claim 1, wherein the system is operated on an online computer network.

7. The electronic gaming system of claim 1, wherein the system is operated on a casino electronic gaming device.

8. The electronic gaming system of claim 1, wherein the system includes a user device in communication with a server wherein the electronic game of blackjack is conducted on the user device in communication with the server.

9. An electronic wagering gaming system for executing instructions over a network, the system comprising:

a server;

a memory device storing instructions that when executed, cause the server to control a game of blackjack; and an interface for displaying the game of blackjack, wherein the game of blackjack includes at least one randomly selected communal card, a plurality of player zones, each of which is operable to receive cards, and a dealer zone, wherein the server initiates the game of blackjack on the electronic gaming device by:

a) displaying on the interface an initial set of identical card values to at least a majority of the plurality of player zones, wherein each of the identical card values is greater than zero;

b) making a determination based on a player input whether to receive an additional communal card for the plurality of player zones;

c) applying the additional communal card to one of the plurality of player zones, wherein the application of the additional communal card is evaluated on a zone-by-zone basis;

wherein an evaluation by the processor is made to apply the communal card or the additional communal card to each of the plurality of player zones;

wherein individual player zone values are defined by values of the applied additional communal card in addition to the initial identical card values, wherein when a determination is made that there should be no more cards dealt to one of the plurality of player zones, an evaluation is made of the dealer zone of whether to add a card value to the dealer zone, the card value being a next sequential communal card, the value of next sequential community card determined on a zone-by-zone basis;

wherein a determination is made via the server if a player zone wins or loses the game by comparing the value of said one of the plurality of player zones against the dealer zone.

10. The electronic wagering gaming system of claim 9, wherein an account balance of the player is adjusted based on a win or loss outcome of the plurality of player zones.

11. The electronic gaming system of claim 9, wherein physical cards are transmitted and received by the system via a smart recognition sensor communicating with the processor, the physical cards being applicable to the game of blackjack.

12. The electronic wagering gaming system of claim 9, wherein each of the plurality of player zones have a starting identical value.

13. The electronic wagering gaming system of claim 9, wherein the system is operated over an online network in communication with the server.

14. The electronic wagering gaming system of claim 9, wherein the system is operated on a casino electronic gaming device in communication with the server.

15. A computer implemented method of operating a wagering game system over a network, the method comprising:

providing a processor, a memory, and an interface, wherein the processor initiates game play of an electronic game of blackjack on the interface, wherein the electronic game of blackjack includes a communal card area displayed on the interface, at least one randomly selected communal card, at least two player zones, and a dealer zone, wherein the at least two player zones are operable to receive cards, wherein the game play comprises the steps of:

a) receiving a wager input value from at least two players;

b) displaying on the interface an initial set of identical card values to at least the majority of the plurality of player zones, wherein each of the identical card values is greater than zero;

c) making a determination based on a player input whether to receive an additional communal card for the plurality of player zones;

d) applying the additional communal card to one of the plurality of player zones, wherein the application of an additional communal card is evaluated on a zone-by-zone basis;

wherein an evaluation by the processor is made to apply the communal card or additional communal cards to each of the player zones;

wherein individual player zone values are defined by the value of the applied communal cards in addition to values of the initial card values, wherein when a determination is made that there should be no more cards dealt to one of the plurality of player zones, an evaluation is made of the dealer zone of whether to add a card value to the dealer zone, the card value being a next sequential communal card, the value of next sequential community card determined on a zone-by-zone basis, wherein a determination is made via the processor if a player zone wins or loses the game by comparing the value of said one of the plurality of player zones against the dealer zone.

16. The computer-implemented method of claim 15, wherein each of the plurality of player zones has an identical starting value.

17. A computer-implemented method for online wagering gaming executed by a gaming server over a communication network, the computer-implemented method comprising:

a) receiving game data at the gaming server, over the communication network, from a plurality of user devices associated with player account information, the gaming server including a database for storing game data of a plurality of online games including a blackjack game, the blackjack game comprising a plurality of player zones and a dealer zone, each of which being operable to receive community cards from a community card assembly;

b) receiving, at the gaming server, processor information that a plurality of players are to participate in playing the blackjack game;

c) providing to at least a majority of the plurality of player zones identical positive card values on an electronic interface via the gaming server;

d) evaluating for each of the plurality of player zones whether to receive an additional communal card;

e) applying the additional communal card to each of the plurality of player zones, wherein the application of the additional communal card is evaluated on a zone-by-zone basis, such that the additional communal card is applied to the plurality of player zones concurrently and sequentially;

f) wherein when a determination is made that there should be no more cards added to one of the plurality of player zones, an evaluation is made of the dealer zone as to whether to add a card value to the dealer zone, the card value being a next sequential card from the community card assembly;

g) wherein an evaluation is made to add additional cards to the dealer zone or refrain from said adding additional cards to the dealer zone; and h) wherein a determination if a player wins or loses the game is made by comparing the value of said one of the plurality of player zones against the dealer zone;

wherein operations of the method are executed by a processor.

18. The computer-implemented method of claim 17, wherein all of the player zones have an identical starting value.

19. A non-transitory computer-readable storage medium storing a computer program product performing a method for online gaming executed by a gaming server, the computer-readable storage medium comprising program instructions for:

a) receiving game data at the gaming server, over a communication network, from a plurality of user devices associated with player account information, the gaming server including a database for storing the game data, wherein the game data is associated with a plurality of online games, the plurality of online games including a blackjack game, the blackjack game comprising a plurality of player zones and a dealer zone, each of which are operable to receive community cards from a community card assembly;

b) receiving, at the gaming server, information that a plurality of players are to participate in said blackjack game;

c) providing to at least a majority of the plurality of player zones identical positive card values on an electronic interface via the gaming server;

d) evaluating from each of the plurality of player zones whether to receive an additional communal card;

e) applying the additional communal card to each of the plurality of player zones, wherein the application is evaluated on a zone-by-zone basis wherein the application of the additional communal card is applied to the plurality of player zones concurrently and sequentially;

f) wherein when a determination is made that there should be no more cards added to one of the plurality of player zones, an evaluation is made of the dealer zone as to whether to add a card value to the dealer zone, the card being a next sequential card from the community card assembly, the value of next sequential community card determined on a zone-by-zone basis;

g) wherein an evaluation is made to add additional cards to the dealers zone or refrain from said adding additional cards to the dealer zone; and h) wherein a determination if a player zone wins or loses the game by comparing the value of said one of the plurality of player zones against the dealer zone.

20. The non-transitory computer-readable storage medium of claim 19, wherein each of the plurality of player zones has a starting identical value.

* * * * *